United States Patent [19]

Rogers et al.

[11] 4,288,788

[45] Sep. 8, 1981

[54] ELECTROSTATIC ALPHA-NUMERIC DISPLAY

[75] Inventors: Wesley A. Rogers, Grosse Pointe Park; James J. Laggan, Troy, both of Mich.

[73] Assignee: General Motors Corporation, Detroit, Mich.

[21] Appl. No.: 150,896

[22] Filed: May 19, 1980

[51] Int. Cl.[3] ..... G08B 5/00

[52] U.S. Cl. ..... 340/378.2; 340/373

[58] Field of Search ..... 340/373, 387.2

[56] References Cited

U.S. PATENT DOCUMENTS 3,648,281 3/1972 Dahms ..... 340/373

4,091,382 5/1978 Anderson ..... 340/373

*Primary Examiner*—Harold I. Pitts

*Attorney, Agent, or Firm*—Warren D. Hill

[57] ABSTRACT

To provide a nonvolatile alpha-numeric display, display segments comprising small electrets are arranged in a supporting panel in a desired format such as a conventional seven-segment display. Each electret segment is pivotably mounted in a window in the support panel and has opposite faces of contrasting colors so that the rotational position of the electret segment determines its appearance. Electrodes on opposite sides of each window are connected to a control circuit for applying an electrostatic field across the window effective to cause rotation of the segment from one state to another. Various alpha-numeric characters can be formed by selectively rotating the segments. A switch function on each segment allows the status of each segment to be electrically sensed to thereby provide a nonvolatile memory.

4 Claims, 5 Drawing Figures

ELECTROSTATIC ALPHA-NUMERIC DISPLAY

BACKGROUND OF THE INVENTION

Alpha-numeric displays are produced in many forms which are operated by electrical signals usually provided by an electronic control circuit. Such displays are attractive and versatile but usually they are volatile. That is, they do not retain their state when the electrical signal is removed. The use of a nonvolatile memory in conjunction with such a volatile display increases the cost of the display by an amount which is often prohibitive. Even if such a memory is provided the display is not active when electrical power is turned off. Still many applications require nonvolatile displays as well as nonvolatile memories. For example, the odometer of an automotive vehicle must reliably accumulate distance information and retain that information even though the vehicle battery is removed for servicing or the electrical power is otherwise interrupted. The mechanical number wheel odometer driven by an electrically actuated stepper motor accomplishes the purpose of a nonvolatile display responsive to an electrical input, but such a device consumes an objectionable amount of space and is limited in its versatility.

It is therefore an object of the invention to provide a nonvolatile display which is responsive to an electrical signal, is compact and in addition requires no expensive nonvolatile memory element. It is a further object to provide such a display which serves as a nonvolatile memory.

SUMMARY OF THE INVENTION

The invention is carried out by providing an alphanumeric display having segments formed of electrets rotatably mounted in a housing and circuitry for applying electrostatic fields across the electrets to selectively rotate them to desired states, the segments being provided with contrasting colors to provide a distinctive appearance in each state. The invention is further carried out by furnishing a circuit to electrically sense the state of each segment to thereby provide a memory function.

BRIEF DESCRIPTION OF THE DRAWING

The above and other advantages will be made more apparent from the following specification taken in conjunction with the accompanying drawings wherein like reference numerals refer to like parts and wherein.

DESCRIPTION OF THE PREFERRED EMBODIMENT

Figure 1:
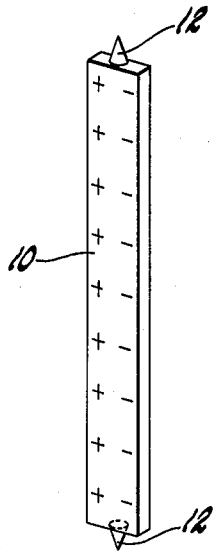
FIGS. 1 and 2 respectively show an electret display segment alone and in place in a display panel, according to the invention.
Figure 2:
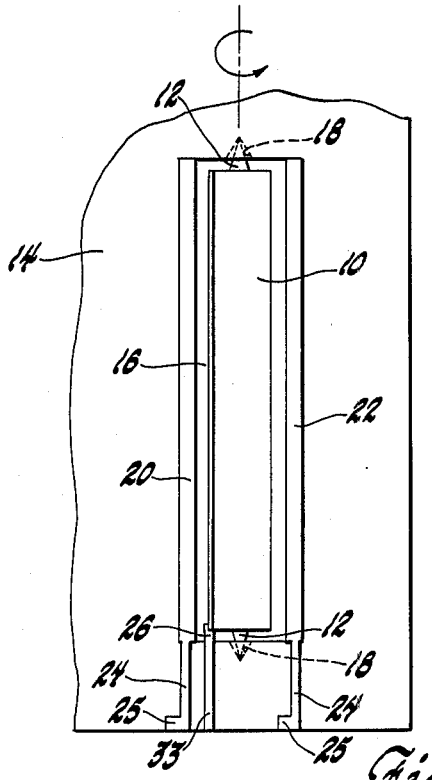

Referring to FIGS. 1 and 2 an electret 10 of the elongated rectangular form has a sharp upper and lower conical tips or pivot pins 12 centered on a longitudinal axis of the electret. The electret is formed of any rigid material which will permanently store positive and negative charges along its opposed longitudinal edges as is well known in the electret art. Such materials includes various polymeric resins such as nylon, polytetraflouroethylene, polyacrylate resins and an acetal resin derived from the polymerization of formaldehydes. Those materials will retain electric charges if these charges are induced in the molten state and allowed to remain as the material hardens. The electret segment is formed, for example, in a mold lined with metallic strips along the longitudinal edges. Liquified resin is poured into the mold and allowed to set while a voltage is maintained on the metallic strips. This operation creates a permanent distribution of positive and negative charges locked into the right and left strip edges respectively thus producing an electret. There are other materials such as ceramics which may be used for electrets and there are other methods of inducing the electric charges. These details are known in the art and are set forth, for example, in "Electrostatics and its Applications", A. D. Moore, John Riley and Sons.

The electrets are supported in a display panel 14 which is, for example, formed of an insulating substrate with suitable apertures and carrying conductors on its surface like a printed circuit board. As best known in FIG. 2, the display panel 14 has an elongated window 16 slightly larger than the electret 10 for receiving the electret segment and the ends of the window contain recesses 18 which pivotably receive the axis tips 12 of the electret so that the electret segment can freely pivot about its longitudinal axis within the window 16. The electret can be installed by flexing it slightly to snap the tips 12 into their respective recesses 18. Longitudinal electrodes 20 and 22 lie on the panel along either side of the window 16 separated by a small air gap from the charged edges of the electret segment 10. Conductors 24 extend from the electrodes to terminals 25 at the edge of the display panel and allow voltages of opposite polarities to be applied to the electrodes for establishing an electrostatic field between the electrodes across the window. The electrostatic field when applied will induce an attractive or repulsive force on the charges on the electret in order to either hold the segment in place or cause rotation of the segment substantially 180°. A small tang 26 upstanding from the bottom of the window 16 interferes with the electret segment 10 enough to prevent a planar alignment of the electret with the electrodes in order to avoid the condition of zero torque when the electostatic field is applied. Thus, the segment is held in or moved to either one of two states according to the polarity of the applied voltage. Thus, the electret segment is a bistable device. The segment is differently colored on its two sides in order to visually distinguish between the two states. Preferably one side of the segment is a color which blends with the color of the display panel and the other side is a contrasting color, i.e. black versus white.

For a segment with dimensions of length-5 millimeters, width-1 millimeter and thickness-0.25 millimeters and an embedded charge density of $10^{-5}$ coulombs/square meter along the edges will rotate 180° in approximately one millisecond under zero friction conditions when 10 volts is applied to the electrodes. By proper selection of materials at the pivot points sufficient static friction can be built into the device to stabilize the electret against rotation due to vibration or stray electrical fields, yet keeping kinetic function sufficiently low to allow quick response to an applied field.

Figure 3:
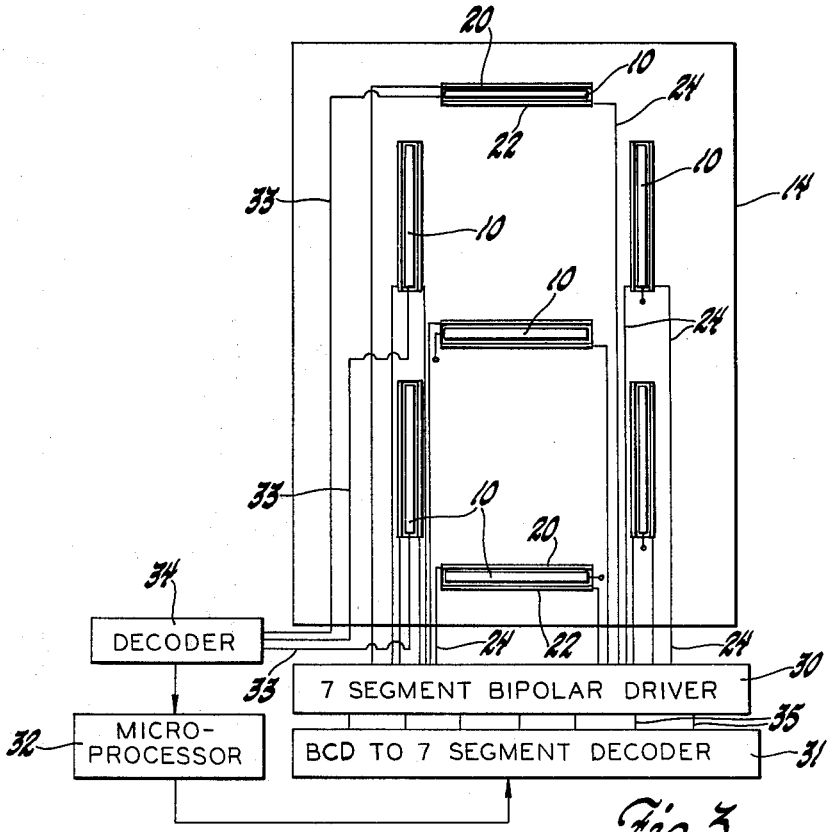
FIG. 3 is a view of a seven-segment display and driving circuitry according to the invention.

A seven-segment display is shown in FIG. 3 which is comprised of a panel 14 like that of FIG. 2 containing seven windows with associated electret segments 10. The electrodes 20 and 22 of each window are connected by conductors 24 to a seven-segment bipolar driver 30 which, in turn, is coupled to a BCD to seven-segment decoder 31. The decoder 31 is controlled by a microprocessor 32 which accumulates data in a volatile memory and feeds BCD signals to the decoder. The decoder 31 which is a well known circuit in the display art provides a single output signal for each segment. The bipolar driver 30 converts each of those signals to a bipolar signal so that a positive voltage may be applied to one electrode 20, for example, and the negative voltage applied to the electrode 22 or visa versa. As described fully below, there is provided at each segment a sensor to detect the state of the segment, and this information is used to refresh the volatile memory of the microprocessor 32 when needed. That information is provided on sense lines 33, only three of which are illustrated for simplicity. The sense lines are input to a decoder 34 which converts the seven-segment signal to a binary signal that is fed into the microprocessor 32.

Figure 4:
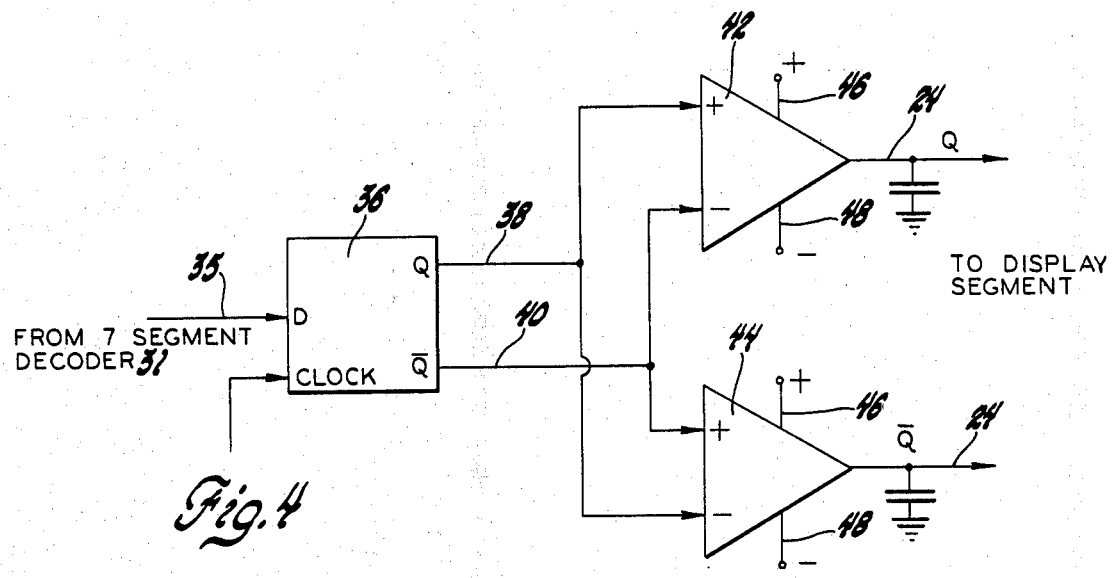
FIG. 4 is an illustration of a bipolar display driver for the circuitry of FIG. 3.

FIG. 4 shows the circuit for converting each output on line 35 of the decoder 31 to a bipolar output on lines 24. The line 35 is connected to the data input of a D flip-flop 36 which has two outputs Q and Q. The outputs are connected by lines 38 and 40 to operational amplifiers 42 and 44, each of which are provided with positive and negative power supply voltages on lines 46 and 48. The line 38 is connected to the positive input terminal of amplifier 42 and the negative input terminal of the amplifier 44. The line 40 is connected to the complementary inputs of those amplifiers so that when the line 38 is positive, the output of the amplifier 42 will be positive and the output of the amplifier 44 will be negative, thereby energizing electrodes 20 and 22 with opposite polarities.

Figure 5:
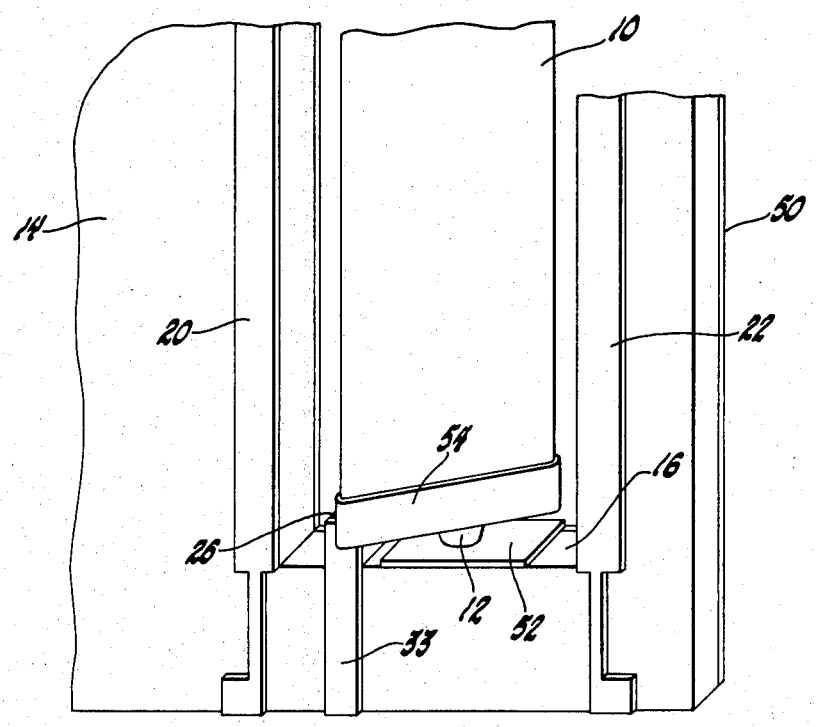
FIG. 5 is a view of an electret segment in a display panel showing the details of a status sensing arrangement according to the invention.

FIG. 5 illustrates in detail, a portion of a display device incorporating the status sensing arrangement that is suggested by FIGS. 2 and 3. The display panel 14 has on its back a conductive surface 50 having an integral flange 52 which extends over part of the bottom edge of the window 16. The upstanding tang 26 at the bottom of the window 16 has on its front surface a conductor 33 or sense line which extends to the edge of the panel. To provide a sensing switch, the bottom of the electret 10 has a narrow strip including the tip 12 which is coated with metal to form a contact element 54 in constant electrical contact with the conductive flange 52 and in selective contact with conductor 33. When the electret is in the position shown in FIG. 5 with the contact element touching the conductor 33, the sensing switch is closed and the line 33 assumes the potential of the conductor 50 which is preferably grounded. When the electret 10 is in its other state, the switch will be open and the conductor 33 will be isolated from the conductor 50. This arrangement allows the status of each segment to be read by the microprocessor via the decoder 34. Therefore the display device with a sensing switch for each segment provides a memory of the display value even in the absence of electrical power.

It will thus be seen that the invention disclosed herein provides a versatile nonvolatile display which can, if desired, serve as a nonvolatile memory.

The embodiments of the invention in which an exclusive property or privilege is claimed are defind as follows:

1. A display device comprising an array of controllable bistable movable electret elements which change in appearance upon change of position so that a desired visible pattern is produced by selective positioning of the elements, each electret element having a pivot axis about which it can rotate to either of two stable positions and two opposed edge portions spaced from the pivot axis and bearing opposite electrical charges, a frame member having an array of windows each provided with pivot points for rotatably supporting an electret element, pairs of conductive strips on opposite sides of the windows, each strip disposed adjacent a charged edge portion of an electret element, whereby when voltage is applied across each pair of strips electrostatic forces are developed on the charged edges to selectively rotate or hold still the electret elements, and means for supplying control voltages to the strips to effect a visible display pattern by selective positioning of electret elements.

2. A display device comprising an array of controllable bistable rotatable electret elements with contrasting colors on opposite sides to effect a change in appearance upon change of position so that a desired visible pattern is produced by selective positioning of the elements, each electret element having a pivot axis about which it can rotate to either of two stable positions and two opposed edge portions spaced from the pivot axis and bearing opposite electrical charges, a frame member comprising an insulating panel having an array of windows each provided with pivot points for rotatably supporting an electret element, pairs of conductive strips on the panel at opposite sides of the windows each strip disposed adjacent a charged edge portion of an electret element, whereby when voltage is applied across each pair of strips electrostatic forces are developed on the charged edges to selectively effect rotation of the electret elements, and means including conductive paths on the panel connected to the strips for supplying control voltages to the strips to effect a visible display pattern by selective positioning of electret elements.

3. A display device with a nonvolatile memory function comprising an array of controllable bistable movable electret elements which change in appearance upon change of position so that a desired visible pattern is produced by selective positioning of the elements, each electret element having a pivot axis about which it can rotate to either of two stable positions and two opposed edge portions spaced from the pivot axis and bearing opposite electrical charges, a frame member having an array of windows each provided with pivot points for rotatably supporting an electret element, pairs of conductive strips on opposite sides of the windows each strip disposed adjacent a charged edge portion of an electret element, whereby when voltage is applied across each pair of strips electrostatic forces are developed on the charged edges to selectively rotate or hold still the electret elements, means including a control circuit for supplying control voltages to the strips to effect a visible display pattern by selective positioning of electret elements, and means electrically connected with the said circuit for sensing the position of each electret element and electrically providing position information to the circuit whereby the display serves as a nonvolatile memory.

4. A display device with a nonvolatile memory function comprising an array of controllable bistable movable electret elements which change in appearance upon change of position so that a desired visible pattern is produced by selective positioning of the elements, each electret element having a pivot axis about which it can rotate to either of two stable positions and two opposed edge portions spaced from the pivot axis and bearing opposite electrical charges, the electret element including a conductive contact element carried by and movable with the electret element, a frame member of insulating material having an array of windows each provided with pivot points for rotatably supporting an electret element, pairs of conductive strips on opposite sides of the windows each strip disposed adjacent a charged edge portion of an electret element, whereby when voltage is applied across each pair of strips electrostatic forces are developed on the charged edges to selectively rotate or hold still the electret elements, means including a control circuit for supplying control voltages to the strips to effect a visible display pattern by selective positioning of electret elements, and switch means including pairs of stationary contacts on the frame member electrically connected with the said circuit for selective closing engagement by the contact elements according to the position of each electret element for thereby sensing the position of each electret element and electrically providing position information to the circuit whereby the display serves as a nonvolatile memory.

* * * * *